US005361499A

United States Patent [19]

Janaway et al.

[11] Patent Number: 5,361,499

[45] Date of Patent: Nov. 8, 1994

[54] WALL PAPER TRIMMER

[76] Inventors: Alexander D. Janaway; Christine Janaway, both of Haydon Bungalow, Ashbrittle, Wellington, Somerset TA21 0LG, United Kingdom

[21] Appl. No.: 867,677

[22] PCT Filed: Dec. 14, 1990

[86] PCT No.: PCT/GB90/01957

§ 371 Date: Jul. 7, 1992

§ 102(e) Date: Jul. 7, 1992

[87] PCT Pub. No.: WO91/08872

PCT Pub. Date: Jun. 27, 1991

[30] Foreign Application Priority Data

Dec. 15, 1989 [GB] United Kingdom ..... 8928423
Nov. 23, 1990 [GB] United Kingdom ..... 9025578

[51] Int. Cl.[5] ..... B26B 5/00; B26B 7/00; B26F 1/00

[52] U.S. Cl. ..... 30/277.4; 30/277; 30/366

[58] Field of Search ..... 30/277.4, 277, 366, 30/168, 164.5, 227, 228; 81/463, 9.22; 173/90

[56] References Cited

U.S. PATENT DOCUMENTS

| | | | |
|---|---|---|---|
| 2,211,741 | 8/1940 | Elwell | 30/277 |
| 2,984,241 | 5/1961 | Carlson | 30/277 |
| 3,152,398 | 10/1964 | Freeman | 30/277.4 |
| 3,382,577 | 5/1968 | Reider | 30/366 |
| 3,509,786 | 5/1970 | Buttner | 81/9.22 |
| 3,525,912 | 8/1970 | Wallin | 318/17 |
| 3,736,614 | 6/1973 | Crostic et al. | 30/277.4 |
| 3,981,275 | 9/1976 | Schimoler | 30/277.4 |
| 4,711,030 | 12/1987 | Ruston, Sr. | 30/277.4 |
| 4,756,085 | 7/1988 | Lebessis | 30/277.4 |

FOREIGN PATENT DOCUMENTS

| | | |
|---|---|---|
| 0195120 | 9/1986 | European Pat. Off. . |
| 3436841 | 4/1986 | Germany . |
| 1147789 | 4/1969 | United Kingdom . |

*Primary Examiner*—Richard K. Seidel
*Assistant Examiner*—Paul M. Heyrana, Sr.
*Attorney, Agent, or Firm*—Edwin D. Schindler

[57] ABSTRACT

A "trim-easy" wall paper trimmer (10) which is light weight, hand-held and comprising of four rechargeable d.c. battery cells (15) contained in a battery chamber (12) and supplying power to a 4.8 volt electric motor (24) which drives a reciprocating action for two spring-loaded cutting rode (29, 30) of some 8000 strokes each minute. The "trim-easy" wall paper trimmer (10) cuts through wall paper coverings in situ and with ease. No scissors or knives are required to shape round switches, sockets, covings or any other wall appurtences. The "trim-easy" trimmer (10) is press-button operated by a conveniently placed finger switch (14) and includes a 2.1 mm standard power charging socket with a LED signal lamp (19) to indicate correct charging procedures. The "trim-easy" trimmer (10) is conveniently and easily held in one hand to direct the cutting rods (29, 30) at a correct angle to ensure paper can be cut cleanly, without tearing and in a fraction of the time it takes to do so by knife or scissors. The 4.8 volt electric motor (24) drives two plastic gear wheels (26, 27) through a plastic material pinion which reduces noise and provides a smooth vitrationless operation.

7 Claims, 3 Drawing Sheets

WALL PAPER TRIMMER

This invention relates to a hand-held, battery powered, wall paper trimmer which can cut, shape or profile wall paper in situ, thus avoiding marking and cutting by scissors around fitments doors, window recesses, skirtings, covings and the like.

The present-day tendency for home owners to carry out decoration and repairs to their properties has increased considerably because of the availability of electrically powered and other hand tools which will perform tasks which were previously deemed to be professional skills.

The 'do-it-yourself' ability has been encouraged, not only by the proliferation of power tools but as a result of the high cost of professional services.

However, not only has the unskilled home owner been encouraged to perform tasks in and about the home by the case with which power tools can perform such tasks, but the professional operative too has made use of these aids to reduce time and provide greater accuracy in carrying out such work.

Home decoration, comprising applying paper to wall surfaces is one task taken on by home owners more frequently, and especially so by ladies. Rolls of wall paper can be purchased which are already trimmed and sized with adhesive which requires only the cut lengths of paper to be immersed in water. Paper manufacturers sometimes provide a waxed paper box to contain water into which the cut lengths of wall paper may be immersed for a short while to moisten the adhesive.

It is in the realm of cutting special shaped in wall paper to fit around electrical switches and sockets on the wall, or around door frames, window frames, conduit pipes, pelmets and other fixed room objects, that D.I.Y. aids have, until now, been given scant attention. It is not a simple task to cut cleanly and accurately a shape to fit an electrical switch in a length of wall paper which has been 'pasted' on the wall-side surface and is therefore wet and slippery. The paper being saturated by the paste is also prone to tearing and is not easy to cut with a scissors, even if marked in some way and the scissors is sharp.

According to the present invention there is provided a hand-held, light-weight, battery powered, electrical trimmer which can cut through wall paper and other paper applications, accurately, neatly and without difficulty in a fraction of the time it would take by scissors or knife.

The trimmer employs a plurality of cutting rods which reciprocate in a horizontal mode at high speed to indent and cut through paper at speed and with accuracy. The trimmer can be held in one hand and its electric motor is energised by depressing a spring-loaded button switch. The battery powered electrical motor will activate through gearing, which is quiet in operation, a series of round, hardened and ground steel or other metal cutting rods which will reciprocate rapidly in a horizontal plane.

The trimmer is placed at the site of any wall projection, the shape of which has to be cut into the paper and is slid along effortlessly about the profile while the paper is in situ.

The slender high speed reciprocating cutting rods penetrate through the paper without applying but a light hand pressure to ensure contact is maintained. The trimmer is powered by four 500 mhc rechargeable dry cell batteries which produce a combined voltage of 4.8 to power the electric motor. The batteries may be recharged from a direct-current power source of 12 volts through a purchasable battery charger. The trimmer has a built-in 2.1 mm charging socket and a LED signal lamp to indicate that the correct charging procedure has been carried out and maintained.

The overall dimensions do not exceed 120 by 40 by 40 millimetres, nor the weight inclusive of the rechargeable batteries no more than 200 grammes.

A specific embodiment of the invention will now be described by way of example only, with reference to the accompanying drawings in which.

FIG. *3a–3d* illustrates some of the more important components in greater detail.

Note; Throughout this specification hereafter the words "cutting rods" will be taken to mean "slender high speed reciprocating cutting rods".

Figure 1:
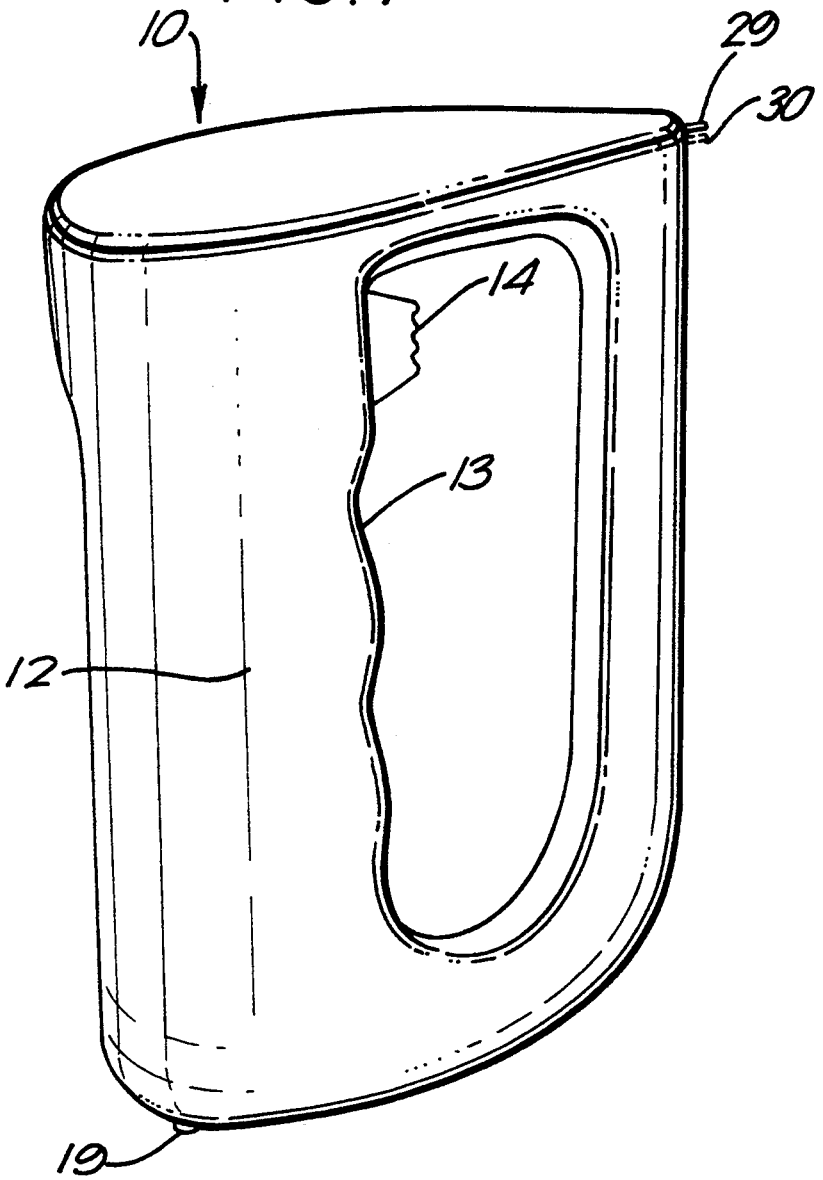
FIG. 1 illustrates the TRIM-EASY trimmer pictorially and about its full size.

Referring to FIG. 1 the TRIM-EASY trimmer body 10 is constructed in a rigid plastic material and shaped to be held in one hand with the cutting rods 29, 30 aimed directly towards any paper in situ on a wall or other surface which has to be cut. The dry cell battery chamber 12 can be conveniently held in one hand with the fingers of that hand placed comfortably in moulded plastic grooves 13 formed in the forward face of the battery and motor chamber 12. A finger, spring-loaded press button 14 is placed near the index finger position and slightly above the last of the grooves 13, to initiate action from the electric motor 24.

The four dry cell, rechargeable batteries 15 are inserted into the battery chamber 12 (see FIG. 2) access to which is obtained by removing four containment screws 16 which releasably secures the half-section cover 17 to the main body moulding.

All movable components are concealed against ingress of dust and moisture by good contact surfaces throughout the cover 17 profile and the main body moulding.

The spring-loaded cutting rods 29, 30 are releasable from their internal mountings through the same half-section cover 17.

This enables the cutting rods 29, 30 to be replaced after certain prolonged periods of use.

While FIG. 1 indicates the preferred shape of the TRIM-EASY trimmer 10 the concept of the innovation can embrace other shapes to enclose and operate the cutting rods 29, 30 and any alternative shape would deem to comply with this herein described concept.

Figure 2:
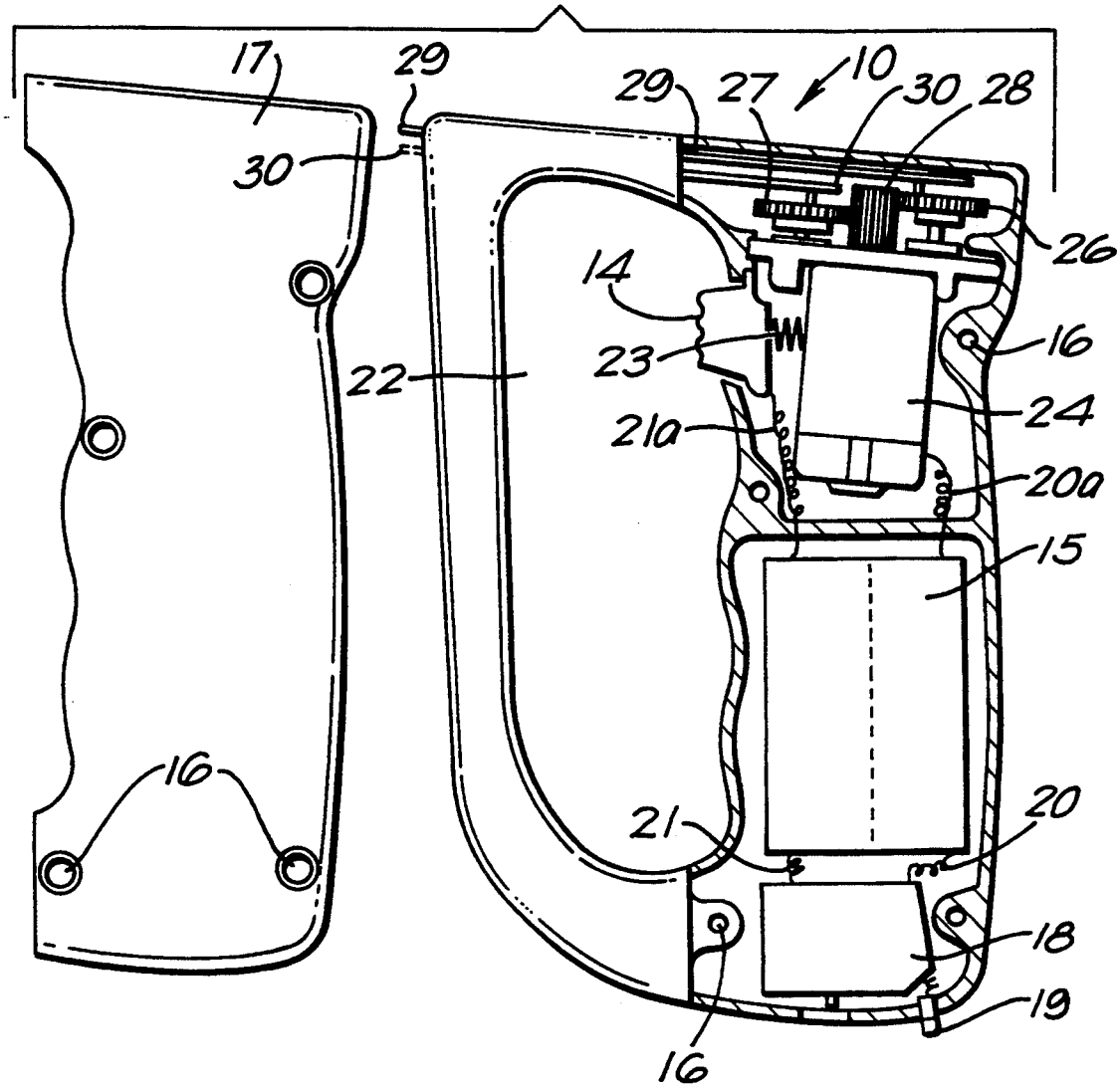
FIG. 2 shows the internal components of the 'TRIM-EASY' trimmer.
Figure 3A:
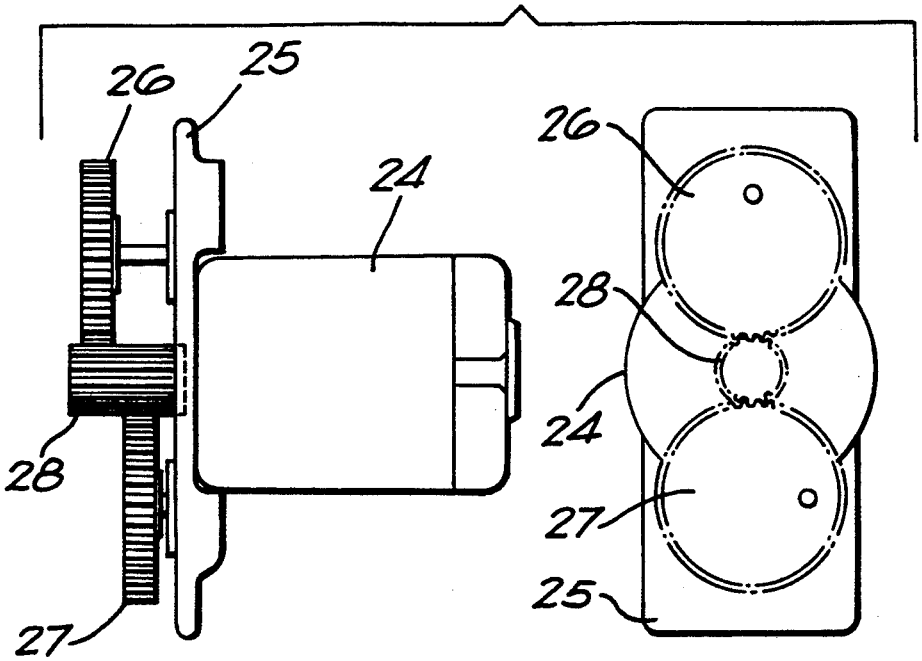
Figure 3B:
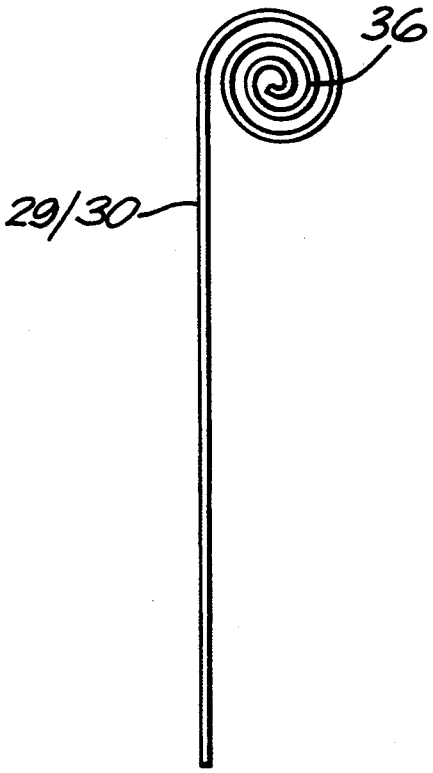
Figure 3C:
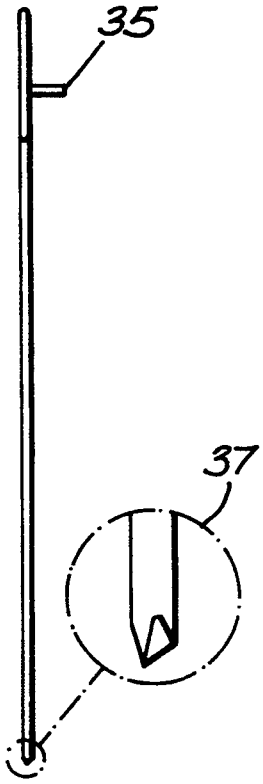
Figure 3D:
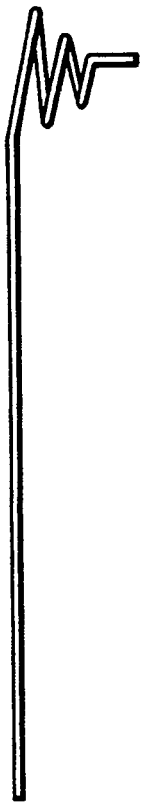

Referring now to FIG. 2 the internal components of the TRIM-EASY trimmer 10 are illustrated and will now be described.

The battery chamber 12 is shown containing the four rechargeable, dry cell batteries 15 which are wrapped in a plastic sleeve to contain them compactly. Below the compact battery pack 15 is the printed circuit board 18 which controls the battery charging and the LED signal light 19. The circuit diagram conforms to conventional circuitry and needs no special description in this specification. The cable connections from the battery pack 15 to the printed circuit board 18 and to the press-button switch 14 and motor 24 are indicated by numerals 20, 20*a*, 21 and 21*a*. The press-button switch 14 is spring-loaded by compression coil spring 23 which engages against the stator of the motor 24 which is itself secured releasably within a cradle depression moulded into the main body of the trimmer 10. There could be alternative method of initiating the start-up of the electric motor and there could be alternative positions for the starter button 14 but all alternative methods for such would be considered to embrace the concept of this invention. The press-button started switch is conveniently beneath the index finger of the hand when the hand grips about the battery/motor chamber and within the cavity 22.

Forward of the motor is a semi-rigid plastic bridge piece 25 which is forcibly pressed into depressions in the moulded main body of the trimmer 10 and is releasably secured to the motor body 24.

This said bridge piece 25 provides self-lubricating bearings for the spindles of the two plastic gear wheels 26, 27.

The centrally positioned plastic pinnion 28 is directly connected to the motor rotor shafting (unseen in FIG. 2).

It will therefore be seen that by the use of plastic gearing the noise level is kept to a minimum. The two cutting rods 29, 30 fit eccentrically into the face of the two gear wheels 26, 27.

Since the same pinion 28 drives the two gear wheels 26, 27 one will rotate in a clock-wise direction and the other in an anti-clockwise direction. The cutting rods 29, 30 are of special construction which will impart a spring-like resilience to them. The drive end of each cutting rod 29, 30 is coiled concentrically immediately adjacent to the outer face of the two gears 26, 27. (See FIG. 3)

The positioning of the eccentric attachment for the cutting rods 29, 30 ensures that they reciprocate at different periods—in other words they stroke at an alternate rate. Since the motor and gearing cause the cutting rods 29, 30 to operate at about 8000 strokes a minute the impact on any paper product to which they are applied will effect a cutting action which is both rapid, clean and precise.

The exposed ends of the two cutting rods 29, 30 may be especially shaped to effect a cutting action or they may be shaped with sharp points depending on the quality of the paper product to be cut.

Referring not to FIG. 3, the electric motor 24, the two gear wheels 26, 27 and the pinnion 28 are illustrated separately and somewhat enlarged to indicate design features.

View 3*a* shows the motor 24, gear wheels 26, 27 and the pinnion 28 in plan and end view. The motor stator 31 is carried between two projections 32 on the semi-rigid plastic bridge piece 25.

These said projections impart a gripping action on the exterior surface of the stator 31 by virtue of the quality of the plastic material which has 'give' characteristics.

The two extremities of the bridge piece 25 press into support grooves moulded into the main body of the trimmer 10 to effect alignment of the motor and gear assembly, 24, 26, 27 and 28.

Similarly, such positioning will provide precise alignment for the two cutting rods 29, 30 as they operate within guide passages in the main body of the trimmer 10. The guide passages are unseen in the FIGS. 1 and 2.

The end view shows the positions of the two fixing holes 33, 34 in the gear wheels 26, 27 which are provided to receive and releasably secure the cutting rods 29, 30. It can be seen from the end view that the setting of each eccentrically placed hole 33, 34 is 'sited' 'off centre' in the face of each said gear wheel and that the setting of each eccentrically placed hole 33, 34 is at opposite points on the pitch circle to one another. As the pinion 28 causes each gear wheel 26, 27 to revolve in opposite directions, one cutting rod 29, will be lifting while the other is dropping and with such rapidity that the point of action of each cutting edge is almost simultaneous.

The pinion 28 projects through the semi-rigid plastic bridge piece 25 which is suitably recessed to ensure no direct contact between pinion 28 and the plastic material will occur.

Pinion 28 is fixedly secured to the central drive shaft of the rotor of the electric motor 24.

In the preferred embodiment the 'teeth' in each gear 26, 27 and the pinion 28 are straight cut—traditionally known as 'spur', but in an alternative embodiment these said gears and pinion could be cut single or double helical as appropriate. However, in what ever profile such 'teeth' are provided for the engagement of gears and pinion are cut they would be considered to embrace the concept described in this specification.

Attention is now directed to view 3*b* which illustrated a cutting rod 29, or 30—only one rod being shown.

The drive end projects away from the centre line of the said rod and is indicated by numerals 35. This projection would be pressed into the hole 33, 34 provided in the gear wheels 26, 27. The cutting rods, 29, 39 are if circular section in the preferred embodiment but the concept includes cutting rods to be made in any other shaped section if the projection ends 35 is retained circular to match the holes 33, 34 in the gear wheels 26, 27.

The cutting rods 29, 30 are given a spring-like resilience by forming the drive end 36 into a series of concentric rings before extending them in a vertical straight line, as shown. The central axis of the spiral rings and the straight length of rod would be in precise alignment. This feature is especially indicated in views 3*c* and 3*d*. The view 3*c* shows the correct and necessary alignment while view 3*d* shows an incorrect alignment relative to this embodiment. Any other embodiment might arrange for such a spiral method to be incorporated, but such would be deemed to embrace the concept herein described.

The cutting end of each cutting rod 29, 30 can be flattened slightly and sharpened to provide a knife-like edge 37 (shown enlarged) or such ends may be sharp pointed or again one rod could be flattened and sharpened while the other rod could be pointed. Such requirement would relate to the recommended use of the trimmer 10 and the quality of the paper product being cut.

The package comprising the 'TRIM-EASY' trimmer 10 would include spare cutting rods 29, 30 for replacement of any such rods which might blunt from extensive and prolonged use.

Thus it can be seen that the 'TRIM-EASY' trimmer 10 as described in this specification is easy to operate, effective and safe. It will cut paper in situ on walls without tearing and with a clean unmarked line.

We claim:

1. A method for perforating a surface covering material, such as wallpaper, said method comprising the steps of:

(a) positioning an apparatus including:

(1) a casing;

(2) at least one pair of longitudinally movable perforating elements having tips;

(3) drive means provided in said casing for effecting alternating, reciprocating longitudinal movement of said pair of perforating elements so that the tips thereof, alternately, are capable of penetrating said surface material; and, (4) means for resiliently mounting said pair of perforating elements to said drive means, said positioning of said apparatus being carried out with the tips of said perforating elements adjacent said surface covering material; and, (b) effecting operation of said drive means for causing said perforating elements to perforate said surface covering material.

2. The method for perforating a surface covering material according to claim 1, wherein said drive means comprise a pinnion wheel engageable with a first gear wheel and a second gear wheel.

3. The method for perforating a surface covering material according to claim 2, wherein said first gear wheel and said second gear wheel are capable of receiving driven ends of said perforating elements.

4. The method for perforating a surface covering material according to claim 2, wherein said pinnion wheel and said first gear wheel and said second gear wheel are arranged so that said pinnion wheel effects rotation of said gear wheels in opposed senses.

5. The method for perforating a surface covering material according to claim 2, wherein said pinnion wheel is connected to a drive shaft of an electric motor.

6. The method for perforating a surface covering material according to claim 1, wherein said resilient mounting means comprise a first spring member and a second spring member, one of said spring members for each of said perforating elements, each of said spring members being releasably mounted on said drive means.

7. The method for perforating a surface covering material according to claim 6, wherein said drive means comprises a pinnion wheel engageable with a first gear wheel and a second gear wheel and wherein said spring members are eccentrically mounted on a respective gear wheel so that operation of said drive means effects alternating, reciprocating longitudinal movement of said perforating elements.

* * * * *